US010168662B1

(12) United States Patent
Kamiya

(10) Patent No.: US 10,168,662 B1
(45) Date of Patent: Jan. 1, 2019

(54) ASSEMBLY REMOVABLE STRUCTURE AND IMAGE FORMING APPARATUS

(71) Applicant: FUJI XEROX CO.,LTD., Tokyo (JP)

(72) Inventor: Shogo Kamiya, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/954,604

(22) Filed: Apr. 17, 2018

(30) Foreign Application Priority Data

Jun. 13, 2017 (JP) ..... 2017-116122

(51) Int. Cl.
*G03G 21/16* (2006.01)
*G03G 15/00* (2006.01)
*G03G 15/20* (2006.01)

(52) U.S. Cl.
CPC ..... *G03G 21/1685* (2013.01); *G03G 15/2064* (2013.01); *G03G 15/80* (2013.01); *G03G 2221/1639* (2013.01)

(58) Field of Classification Search
CPC ..... G03G 21/1685; G03G 15/2064; G03G 15/80; G03G 2221/1639; G03G 2221/16; G03G 21/16; G03G 21/1642; G03G 21/1647; G03G 21/1652
See application file for complete search history.

(56) References Cited

U.S. PATENT DOCUMENTS

2004/0190939 A1* 9/2004 Yamanaka ..... G03G 15/2032 399/122
2016/0033929 A1* 2/2016 Takahashi ..... G03G 21/1685 399/122

FOREIGN PATENT DOCUMENTS

JP H11126009 5/1999

* cited by examiner

*Primary Examiner* — Sandra Brase
(74) *Attorney, Agent, or Firm* — JCIPRNET

(57) ABSTRACT

An assembly removable structure includes an assembly including a connectable member and attached to and removed from a receiving member of an apparatus body in a first direction, a connection member disposed on the apparatus body to be movable forward and backward in a cross direction that crosses the first direction, the connection member being connected to the connectable member while being in a projecting state, a switch member operated independently of a lid member and capable of switching the connection member between a first position, in which the connection member is connected to the connectable member, and a second position, in which the connection member is removed from the connectable member, and a restricting device that restricts removal of the assembly attached to the receiving member, the restricting device switching the switch member from the second position to the first position with an operation of the restriction.

8 Claims, 9 Drawing Sheets

ASSEMBLY REMOVABLE STRUCTURE AND IMAGE FORMING APPARATUS

CROSS-REFERENCE TO RELATED APPLICATIONS

This application is based on and claims priority under 35 USC 119 from Japanese Patent Application No. 2017-116122 filed Jun. 13, 2017.

BACKGROUND

Technical Field

The present invention relates to an assembly removable structure and an image forming apparatus.

SUMMARY

An assembly removable structure according to an aspect of the invention includes an assembly that includes a connectable member and that is attached to and removed from a receiving member of an apparatus body in a first direction, a connection member disposed on the apparatus body to be movable forward and backward in a cross direction that crosses the first direction, the connection member being connected to the connectable member while being in a projecting state, a switch member that is operated independently of a lid member and that is capable of switching the connection member between a first position, in which the connection member is connected to the connectable member, and a second position, in which the connection member is removed from the connectable member, the lid member rendering the receiving member open and closed, and a restricting device that restricts removal of the assembly while the assembly is being attached to the receiving member, the restricting device switching the switch member from the second position to the first position with an operation of the restriction.

BRIEF DESCRIPTION OF THE DRAWINGS

Exemplary embodiments of the present invention will be described in detail based on the following figures, wherein.

DETAILED DESCRIPTION

First Exemplary Embodiment

An assembly removable structure and an image forming apparatus according to the present exemplary embodiment are described as examples.

Entire Structure

Figure 1:
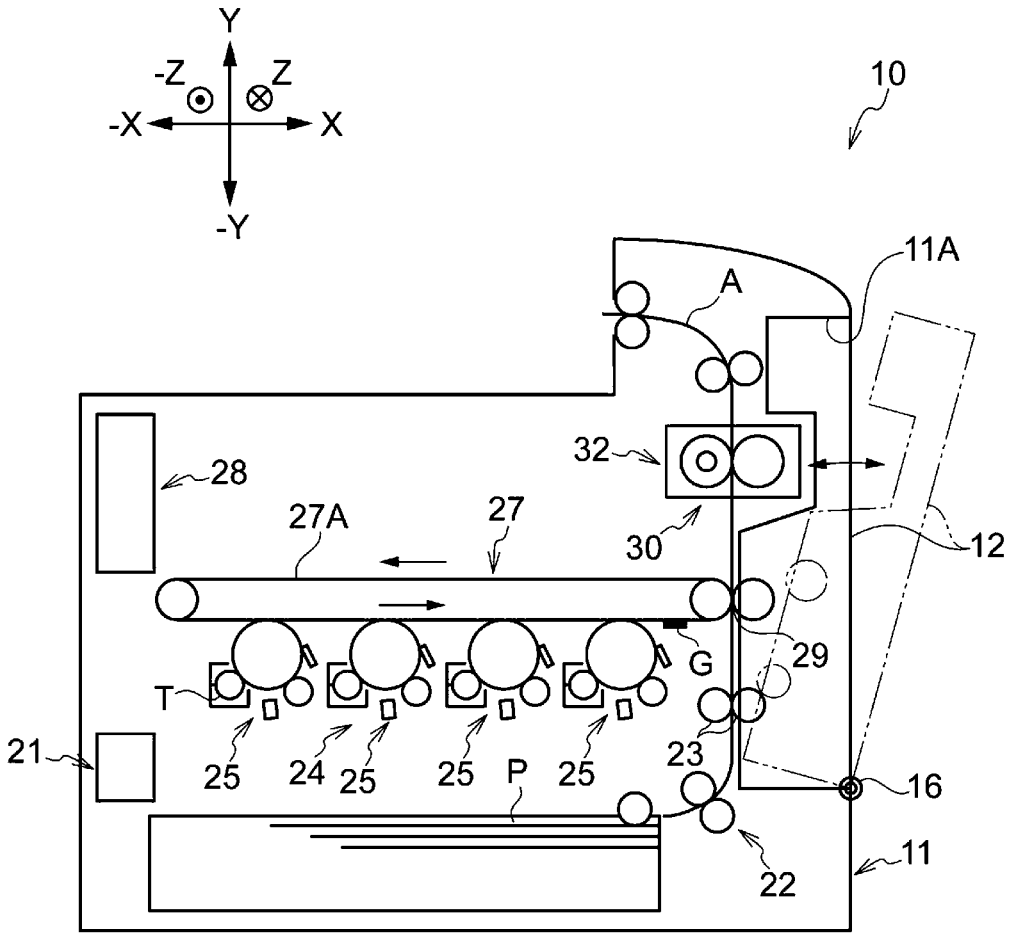
FIG. 1 illustrates an image forming apparatus according to a first exemplary embodiment.

FIG. 1 illustrates an image forming apparatus 10 according to the first exemplary embodiment. In the following description, the direction indicated with arrow Y in FIG. 1 refers to an apparatus height direction, and the direction indicated with arrow X in FIG. 1 refers to an apparatus width direction. The direction (indicated with arrow Z) perpendicular to the apparatus height direction and the apparatus width direction in FIG. 1 refers to an apparatus depth direction. When the image forming apparatus 10 is viewed from the front, the apparatus height direction, the apparatus width direction, and the apparatus depth direction are respectively referred to as a Y direction, an X direction, and a Z direction. When each of the X, Y, and Z directions needs to have its one and the opposite sides distinguished from each other, the upper side is referred to as a Y side, the lower side is referred to as a −Y side, the right side is referred to as an X side, the left side is referred to as a −X side, the rear side is referred to as a Z side, and the front side is referred to as a −Z side, when the image forming apparatus 10 is viewed from the front.

The image forming apparatus 10 includes a box-shaped apparatus body 11. The apparatus body 11 houses a receiving member 13 (see FIG. 2) to which a fixing unit 32, described below, is attached. The receiving member 13 is described in detail below. The apparatus body 11 has a cut in an X side portion. The cut portion is referred to as an opening 11A. A hinge 16, rotatable about its axis extending in the Z direction, is disposed on a −Y side end portion of the opening 11A. A covering 12, which is an example of a lid member, has its −Y side end portion attached to a movable portion of the hinge 16.

For example, the covering 12 has a U-shaped cross section when viewed in the Z direction and extends in the Y direction. The covering 12 is arcuately movable about the hinge 16 between a closed position, in which it closes the opening 11A, and an open position, in which it renders the opening 11A open. In the state where the fixing unit 32, described below, is attached to the receiving member 13, the covering 12 in the closed position covers a pair of positioning rollers 23, a second transfer portion 29, and the fixing unit 32, and the covering 12 in the open position allows the pair of positioning rollers 23, the second transfer portion 29, and the fixing unit 32 to be exposed from the apparatus body 11. The pair of positioning rollers 23 are described below.

The image forming apparatus 10 includes a power supply 21, a transport portion 22, an image forming unit 24, a removable structure 30, which is an example of an assembly removable structure, a driver 26 (see FIG. 3), and a controller 28. The transport portion 22 includes multiple rollers including the pair of positioning rollers 23 to transport sheets P along a transport path A. The sheets P are an example of a recording medium. The transport path A, for example, extends in the Y direction from a lower portion on the −Y side to an upper portion on the Y side of the apparatus body 11.

The image forming unit 24 is an example of a developer image forming device, and includes multiple image forming units 25 and a transfer unit 27. The image forming unit 24 forms toner images G using toner T on a sheet P transported by the transport portion 22. The toner T is an example of a developer. The toner images G are an example of an image and a developer image. The multiple image forming units 25 perform, for example, charging, exposure, and development operations in the known electrophotographic system.

The transfer unit 27 includes an intermediate transfer belt 27A to which toner images G are first-transferred and which second-transfers the first-transferred toner images G onto the sheets P at the second transfer portion 29 on the transport path A. The controller 28 controls operations such as power supply from the power supply 21 to each component of the image forming apparatus 10, transportation of the sheets P performed by the transport portion 22, an image forming operation of the image forming unit 24, and an operation of the driver 26.

Driver

The driver 26 illustrated in FIG. 3 includes a motor, which is not illustrated and rotates a coupling member 34 described below. The driver 26 has its driving operation controlled by the controller 28 (see FIG. 1).

Receiving Member

Figure 2:
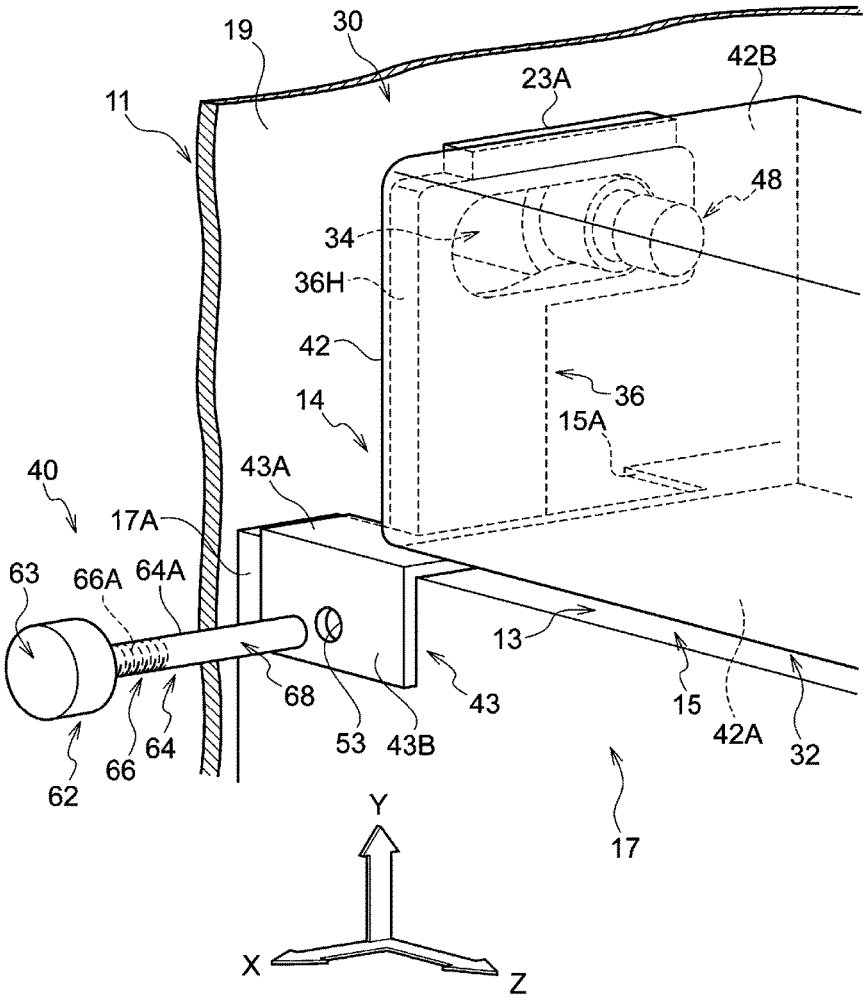
FIG. 2 illustrates a removable structure according to the first exemplary embodiment.

The receiving member 13 illustrated in FIG. 2 includes, for example, a bottom plate 15, extending in the X direction and the Z direction, and a front plate 17, extending to the −Y side from an X side end portion of the bottom plate 15. The −Z side end portion of the bottom plate 15 and the −Z side end portion of the front plate 17 are supported by a side plate 19 standing erect on the apparatus body 11 and extending in the X-Y plane. The bottom plate 15 has a size capable of receiving the entirety of the fixing unit 32, described below. In the apparatus body 11, a portion including the X side end portion of the bottom plate 15 and opening in the X direction is referred to as an opening 14. The receiving member 13 includes a spring that presses the fixing unit 32 away (to the X side in the X direction). The spring is not illustrated.

Figure 4:
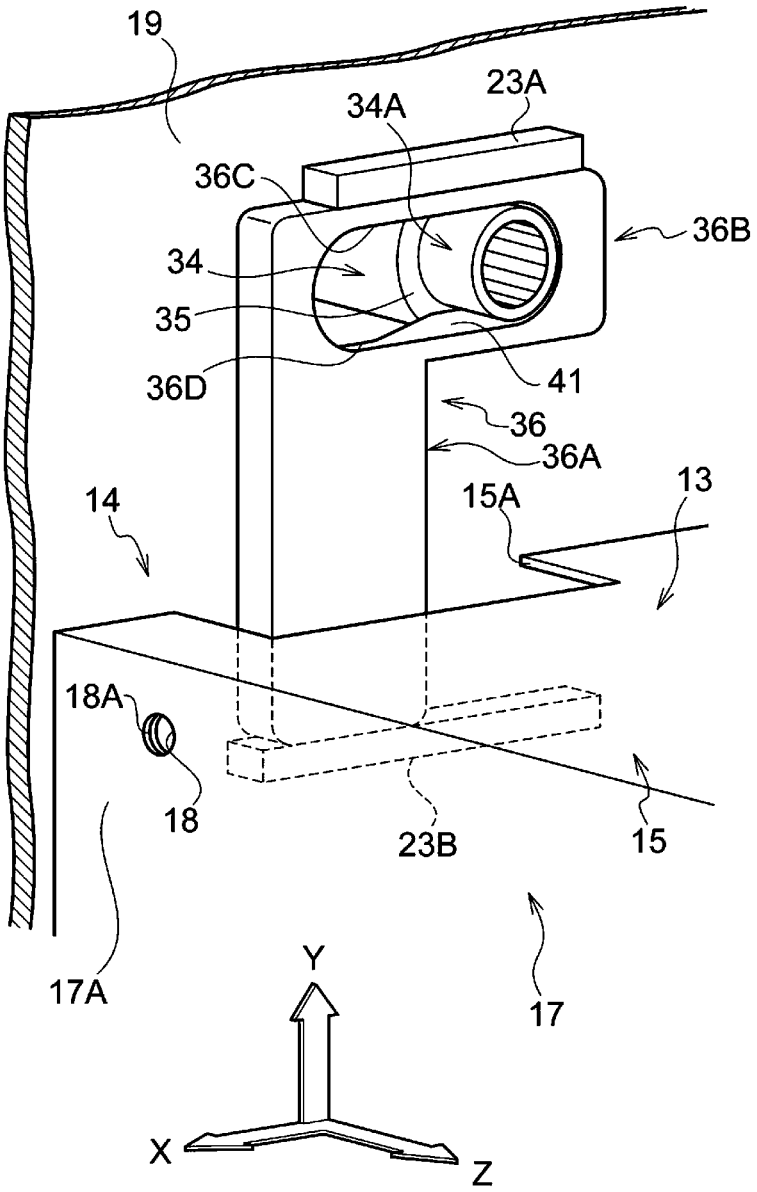
FIG. 4 illustrates a link member and a transmission of a coupling member according to the first exemplary embodiment.

The bottom plate 15 illustrated in FIG. 4 has, at the −Z side end portion, a cut 15A, set back to the center of the bottom plate 15 in the Z direction. For example, the cut 15A has a rectangular shape having a width in the Z direction and a length in the X direction. A link member 36, described below, is disposed in the cut 15A to be movable in the X direction. At a corner 17A of the front plate 17 at the −Z side end portion and the Y side end portion, a hole 18 extends through the front plate 17 in the X direction. An internal thread 18A is formed in the hole wall of the hole 18. When the bottom plate 15 and the front plate 17 are viewed in the Y direction, the hole 18 and the cut 15A are aligned in the X direction.

Guide rails 23A and 23B are disposed on the side plate 19. The guide rail 23A is disposed on the Y side of the bottom plate 15 and extends in the X direction. The guide rail 23B is disposed on the −Y side of the bottom plate 15 and extends in the X direction. The guide rails 23A and 23B hold the link member 36, described below, therebetween in the Y direction to guide the link member 36 in the X direction.

Related Structure

The removable structure 30 is described now.

The removable structure 30 illustrated in FIG. 2 includes a fixing unit 32, which is an example of an assembly, a coupling member 34 on the apparatus body 11, which is an example of a connection member, a link member 36, which is an example of a switch member, a restricting portion 40, which is an example of a restricting device.

Fixing Unit

Figure 3:
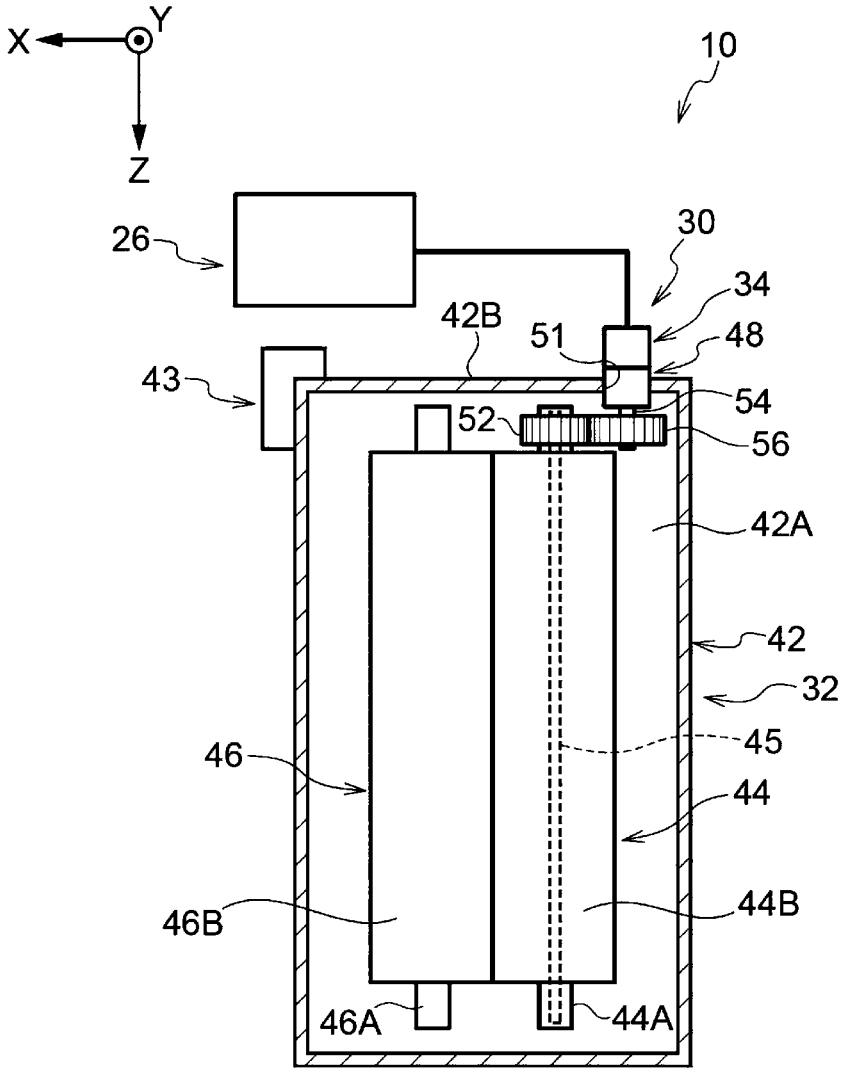
FIG. 3 illustrates a fixing unit and a driver according to the first exemplary embodiment.

The fixing unit 32 illustrated in FIG. 3 includes a housing 42, a bracket 43, a fixing roller 44, which is an example of a rotator, a halogen heater 45, a pressing roller 46, and a coupling member 48 on the fixing unit 32, which is an example of a connectable member.

The housing 42 has a rectangular parallelepiped box shape extending in the Z direction. The housing 42 includes a rectangular bottom plate 42A, having a length in the Z direction and a width in the X direction when viewed in the Y direction, and a side plate 42B, standing erect in the Y direction at the −Z side end portion of the bottom plate 42A. The side plate 42B has a through hole 51, which extends through the side plate 42B in the Z direction.

The bracket 43 illustrated in FIG. 2 is attached to the −Z side end portion and the X side end portion of the bottom plate 42A with a screw not illustrated. The bracket 43 includes a plate portion 43A and a plate portion 43B. When viewed in the Y direction, the plate portion 43A has a rectangular shape having a length in the Z direction and a width in the X direction and extends from the bottom plate 42A to the X side. When viewed in the X direction, the plate portion 43A extends from the housing 42 to the −Z side. The plate portion 43B extends to the −Y side in the Y direction from the X side end portion of the plate portion 43A. Specifically, the bracket 43 has a L-shaped cross section when viewed in the Z direction. The plate portion 43B has a through hole 53 extending through the plate portion 43B in the X direction.

The fixing roller 44 illustrated in FIG. 3 includes, for example, a cylindrical core bar 44A and a coating portion 44B on the outer circumferential surface of the cylindrical core bar 44A. The coating portion 44B includes an elastic layer and a release layer. The fixing roller 44 is disposed on the −X side of the transport path A (see FIG. 1) in the housing 42 to be rotatable about the axis extending in the Z direction. The halogen heater 45 is disposed in the core bar 44A so as not to come into contact with the core bar 44A.

The halogen heater 45 generates heat with energization to heat the fixing roller 44. A gear 52 is attached to the core bar 44A on the outer circumference of the −Z side end portion. The fixing roller 44 has its temperature detected by a temperature sensor, not illustrated. When the temperature sensor detects a temperature lower than a predetermined temperature, the halogen heater 45 is energized. When the temperature sensor detects a temperature higher than or equal to the predetermined temperature, the halogen heater 45 is stopped being energized.

For example, the pressing roller 46 includes a cylindrical core bar 46A and a coating portion 46B on the outer circumferential surface of the cylindrical core bar 46A. The coating portion 46B includes an elastic layer and a release layer. The pressing roller 46 is disposed in the housing 42 on the X side of the transport path A (see FIG. 1) to be rotatable about the axis extending in the Z direction. The pressing roller 46 is movable by a retract mechanism, not illustrated and including a spring, between a pressing position, at which it presses the fixing roller 44, and a retract position, at which it is spaced from the fixing roller 44. The pressing roller 46 forms a nip while having its outer circumferential surface pressing the outer circumferential surface of the fixing roller 44.

The coupling member 48 is cylindrical and disposed in the housing 42 to be rotatable about the axis extending in the Z direction. The coupling member 48 includes multiple protrusions, not illustrated, at intervals in the circumferential direction on the outer circumferential surface of the coupling member 48. The coupling member 48 has its −Z side end portion exposed to the outside of the housing 42 through a through hole 51 of the side plate 42B. A rotation shaft 54 is attached to the Z side end portion of the coupling member 48 to have its rotation center arranged coaxially with the rotation center of the coupling member 48.

A gear 56 is attached to the rotation shaft 54. The gear 56 is engaged with the gear 52. Thus, the fixing roller 44 is rotated when the coupling member 48 is rotated. The fixing roller 44 is thus rotated by the rotational force transmitted from the driver 26 via a coupling member 34, described below, and fixes the toner image G (see FIG. 1) to the sheet P.

The fixing unit 32 illustrated in FIG. 2 is attached to the receiving member 13 from the X side in the X direction and removed toward the X side. In the present exemplary embodiment, an example of a first direction is the X direction, and an example of a cross direction is the Z direction.

Coupling Member

Figure 5A:
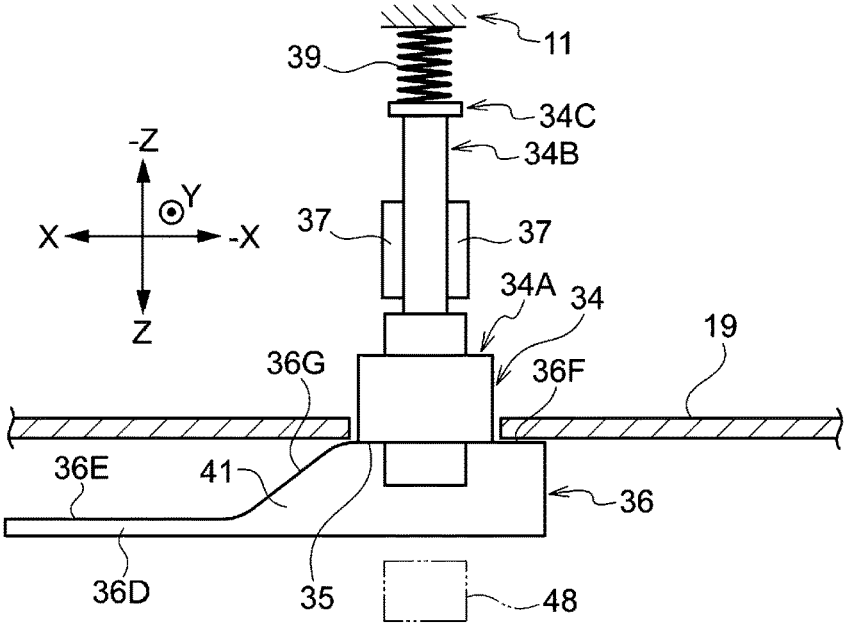
FIG. 5A illustrates the transmission of the coupling member according to the first exemplary embodiment in a retracted state.

The coupling member 34 illustrated in FIG. 5A includes, for example, a connection portion 34A, having a cylindrical shape having an axis extending in the Z direction, a shaft portion 34B, extending to the −Z side from the connection portion 34A in the Z direction, and a wide portion 34C disposed at the −Z side end portion of the shaft portion 34B. The connection portion 34A has an annular contact surface 35 when viewed from the Z side in the Z direction. The coupling member 34 is rotatable in the apparatus body 11 about its axis extending in the Z direction.

The shaft portion 34B is supported by guide members 37, disposed in the apparatus body 11 and extending in the Z direction, to be movable in the Z direction. The coupling member 34 is capable of moving in the Z direction to the Z side toward the coupling member 48 and to the −Z side away from the coupling member 48. The coupling member 34 is pressed to the Z side by a coil spring 39 coming into contact with the wide portion 34C.

Figure 5B:
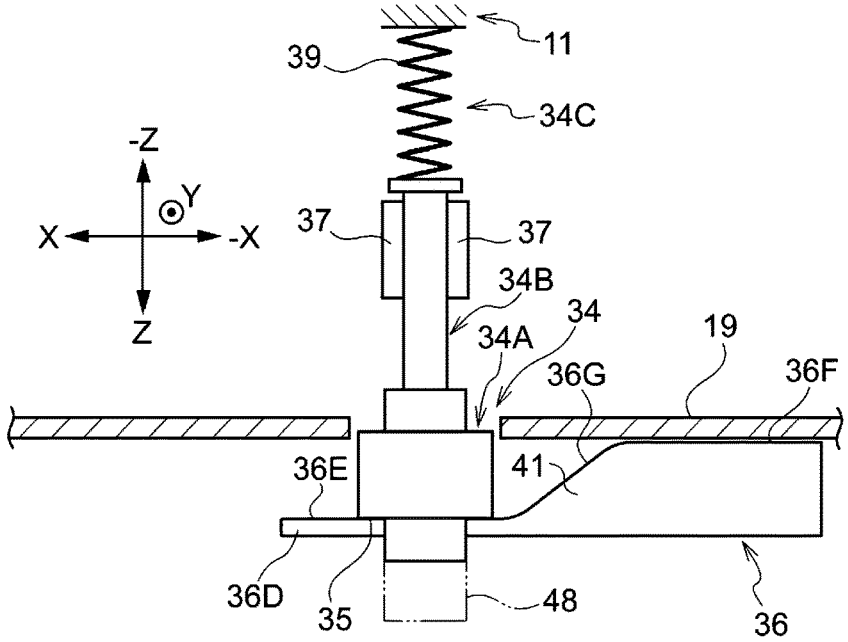
FIG. 5B illustrates the transmission of the coupling member according to the first exemplary embodiment in a projecting state.

The coupling member 34 has multiple recesses, not illustrated and spaced at intervals in the circumferential direction. These recesses engage with protrusions, not illustrated, of the coupling member 48 (see FIG. 3). Specifically, the coupling member 34 in a projecting state is connected to the coupling member 48 to transmit rotational force to the coupling member 48. The coupling member 34 transmits a rotational force to the coupling member 48 when driven to rotate by the driver 26 (see FIG. 3). For ease of understanding the structure of the coupling member 34, FIGS. 5A and 5B illustrate a structure in which the wide portion 34C is pressed against the coil spring 39. Actually, the shaft portion 34B is driven to rotate by a gear of the driver 26, not illustrated, and the connection portion 34A is pressed by the coil spring 39.

Link Member

The link member 36 illustrated in FIG. 4 is disposed at only the −Z side end of the receiving member 13. As described above, the link member 36 is held between the guide rails 23A and 23B in the Y direction to be guided in the X direction. The link member 36 is, for example, a member having a thickness in the Z direction and has a L-shaped contour when viewed in the Z direction. Specifically, the link member 36 includes a leg portion 36A, extending in the Y direction, and a cam portion 36B, extending to the −X side in the X direction from the Y side end portion (upper end portion) of the leg portion 36A.

When viewed in the Z direction, the leg portion 36A has a rectangular shape having a length in the Y direction and a width in the X direction. Part of the leg portion 36A is inserted into the cut 15A. When viewed in the Z direction, the cam portion 36B has a rectangular shape having a width in the Y direction and a length in the X direction. The cam portion 36B has a long hole 36C, which extends through the cam portion 36B in the Z direction and extends long in the X direction.

The long hole 36C has a dimension in the X direction that is longer than or equal to twice the dimension of the connection portion 34A of the coupling member 34 in the X direction and longer than the distance from a second position to a first position, described below, in the X direction. The dimension of the long hole 36C in the Y direction is longer than the dimension of the connection portion 34A in the Y direction. In this manner, the size of the long hole 36C is adjusted to the distance by which the link member 36 needs to move for the coupling member 34 to move forward in the Z direction. The hole wall of the long hole 36C is referred to as a hole wall portion 36D. At portions of the hole wall portion 36D facing in the Y direction and disposed on the −X side of the center of the long hole 36C in the X direction, overhanging portions 41 overhang from the hole wall portion 36D to the −Z side.

As illustrated in FIG. 5A, the −Z side end surface of the hole wall portion 36D is referred to as an end surface 36E. The −Z side end surface of the overhanging portion 41 is referred to as an end surface 36F. The end surface 36E extends in the X-Y plane. The end surface 36F extends in the X-Y plane. An inclined surface 36G is disposed to connect the end surfaces 36E and 36F to each other in the X direction. The inclined surface 36G is inclined with respect to the X direction from the −X side end of the end surface 36E to the X side end of the end surface 36F. While the end surface 36F and the contact surface 35 of the coupling member 34 are in contact with each other, the coupling member 34 is spaced apart from the coupling member (see FIG. 2). The position of the link member 36 in this state is referred to as a second position.

On the other hand, while the end surface 36E and the contact surface 35 are in contact with each other, as illustrated in FIG. 5B, the coupling member 34 is connected to the coupling member 48 (see FIG. 2). The position of the link member 36 in this state is referred to as a first position. Here, the link member 36 is switchable between the first position and the second position by moving in the X direction along the guiderails 23A and 23B (see FIG. 4).

Figure 6A:
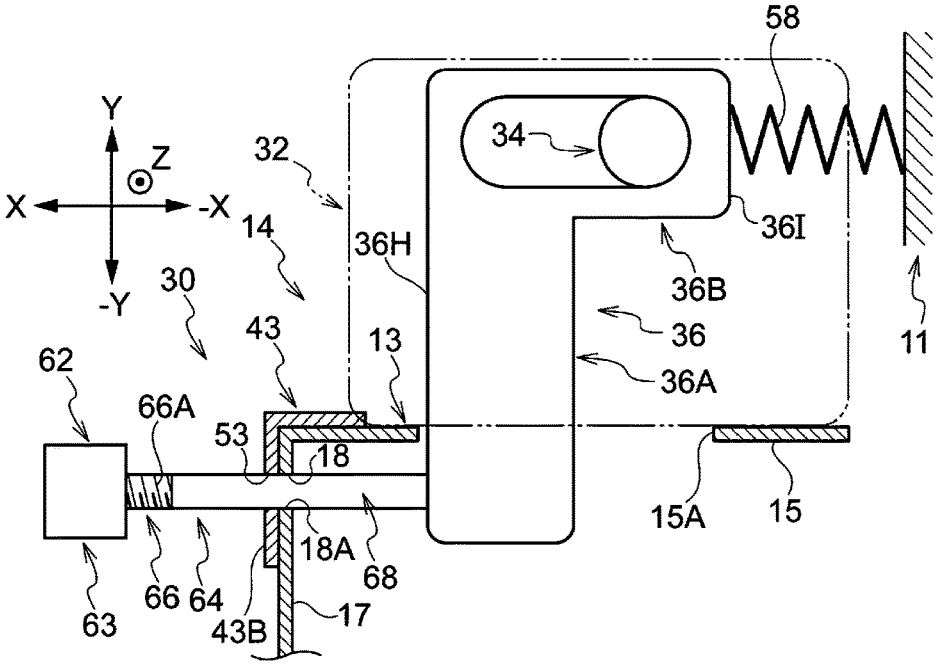
FIG. 6A illustrates the link member according to the first exemplary embodiment in a second position and FIG. 6B illustrates the link member according to the first exemplary embodiment in a first position.

As illustrated in FIG. 6A, an upper portion of the leg portion 36A and a center portion of the leg portion 36A in the Y direction are disposed in the space on the Y side of the bottom plate 15. A lower portion of the leg portion 36A in the Y direction is disposed in the space on the −Y side of the bottom plate 15 through the cut 15A. The X side end surface of the leg portion 36A is referred to as an end surface 36H. The −X side end surface of the cam portion 36B is referred to as an end surface 36I. A coil spring 58, disposed to be elastically deformed in the X direction, is in contact with the end surface 36I. The link member 36 is pressed to the X side by the coil spring 58.

The link member 36 is moved independently of the covering 12 (see FIG. 1). Moved independently here refers to the case where the link member 36 is not moved by the force for operating the covering 12 and that the covering 12 is not moved by an operation of the link member 36.

Restricting Portion

The restricting portion 40 illustrated in FIG. 2 includes the front plate 17, which is an example of a body member, and a thumb screw 62, which is an example of a restricting device (restricting member).

The thumb screw 62 includes a knob 63, having a cylindrical shape having an axis extending in the Z direction, and a shaft portion 64, having a cylindrical (stick) shape having an axis extending in the Z direction from the center of the knob 63. The shaft portion 64 has an outer diameter smaller than the outer diameter of the knob 63. The shaft portion 64 has an outer circumferential surface 64A. The outer diameter of the shaft portion 64 is determined to be insertable into the through hole 53 of the bracket 43. The length of the shaft portion 64 in the Z direction is the sum of the length that allows the link member 36 to switch (move) from the second position to the first position while the end of the shaft portion 64 is in contact with the end surface 36H of the link member 36 and the length that allows for a margin (play).

The shaft portion 64 includes, on the outer circumferential surface 64A, a screw portion 66, having an external screw 66A, and a non-screw portion 68, not having the external screw 66A. The screw portion 66 is disposed closer to the knob 63 (on the base end) than the center of the shaft portion 64 in the Z direction. The portion of the shaft portion 64 other than the screw portion 66 (including the distal end) is a non-screw portion 68. The non-screw portion 68 has a smaller outer diameter than the screw portion 66. The external screw 66A engages with the internal thread 18A (see FIG. 4) of the front plate 17.

In the state where the fixing unit 32 is attached to the receiving member 13, the through hole 53 and the hole 18 (see FIG. 4) are aligned in the Z direction. In this state, while the thumb screw 62 is moved in the X direction and the link member 36 is in the first position, the external screw 66A is engaged with the internal thread 18A, so that the fixing unit 32 is restricted from being removed. In other words, the thumb screw 62 fixes the fixing unit 32 to the receiving member 13. The thumb screw 62 switches the link member 36 from the second position to the first position in the X direction in accordance with the operation for restricting removal of the fixing unit 32.

Operations

Operations according to the first exemplary embodiment are described now.

As illustrated in FIG. 4, in the state where the fixing unit 32 (see FIG. 2) is not attached to the receiving member 13, the link member 36 is disposed on the X side of the center of the cut 15A in the X direction. Here, the coupling member 34 is retracted in the retract position.

Subsequently, as illustrated in FIG. 2, the fixing unit 32 is attached to the receiving member 13 from the X side in the X direction. At this time, the coupling member 34 faces the coupling member 48 in the Z direction. The bracket 43 comes into contact with the front plate 17 and the bottom plate 15. Thus, the hole 18 (see FIG. 4) communicates with the through hole 53 in the X direction.

As illustrated in FIG. 6A, the shaft portion 64 of the thumb screw 62 is then inserted into the through hole 53 and the hole 18, and the distal end of the non-screw portion 68 comes into contact with the end surface 36H of the link member 36. When the thumb screw 62 is pressed toward the −X side, the link member 36 moves to the −X side. Specifically, switching the link member 36 from the second position to the first position allows the coupling member 34 to project to the Z side and to be connected to the coupling member 48 (see FIG. 2).

Figure 6B:
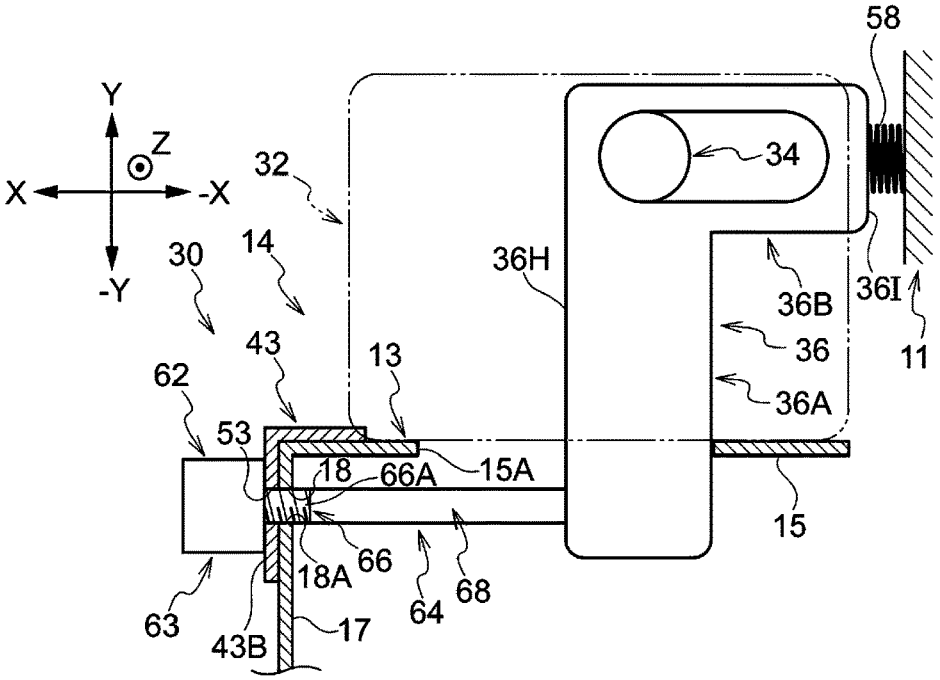

As illustrated in FIG. 6B, in the state where the external screw 66A and the internal thread 18A are in contact with each other, the thumb screw 62 is rotated to engage the external screw 66A and the internal thread 18A with each other. Thus, the thumb screw 62 is fastened to the receiving member 13. In this fastening state, the plate portion 43B of the bracket 43 is held between the front plate 17 and the knob 63. Thus, the fixing unit 32 is restricted from being removed from the receiving member 13.

As described above, in the removable structure 30, the link member 36 is switched from the second position to the first position with an operation on the thumb screw 62 for restricting removal of the fixing unit 32 from the receiving member 13. This structure eliminates the need for separately performing an operation of restricting removal of the fixing unit 32 and an operation of switching the link member 36 from the second position to the first position. This structure thus simplifies the operation compared to the structure that separately performs the operation of restricting removal of the fixing unit 32 and the operation of switching the link member 36.

Moreover, the operation of switching the link member 36 between the first position and the second position is performed separately from the operation of opening and closing the covering 12 (see FIG. 1). When the covering 12 is opened or closed due to, for example, the transport path A (see FIG. 1) being jammed with a sheet P in the middle, neither the link member 36 is switched nor the coupling member 34 is moved. This structure reduces degradation of the coupling member 34 further than the structure in which the switching of the link member 36 is linked with opening or closing of the covering 12. The degradation of the coupling member 34 here includes excessive wearing of a connection portion between the coupling members 34 and 48 caused by the coupling members 34 and 48 (see FIG. 2) being displaced with each other in the X direction and flaws caused by the outer peripheral surfaces of the coupling members 34 and 48 coming into contact with each other.

In the removable structure 30, the direction in which the fixing unit 32 is attached to the receiving member 13 is aligned with the direction in which the link member 36 is switched with an operation on the thumb screw 62 to restrict removal of the fixing unit 32. Thus, an operator operates the thumb screw 62 while watching the fixing unit 32 that is to be attached to the receiving member 13. This structure facilitates an operation of switching the link member 36 compared to the structure in which the restricting device is moved in a first direction, and then in the cross direction to restrict removal of the fixing unit 32.

In the removable structure 30, the thumb screw 62 includes the screw portion 66 and the non-screw portion 68. In this structure, the link member 36 is switched with a simpler operation than in the structure including a thumb screw 62 having a screw portion 66 over the entire area since the thumb screw 62 is rotated for a shorter distance in the switching of the link member 36. Specifically, the link member 36 is switched to the first position by the non-screw portion 68 without rotating the thumb screw 62. Then, the thumb screw 62 is rotated using the screw portion 66, so that the fixing unit 32 is restricted from being removed. Thus, the fixing unit 32 is restricted from being removed with a simpler operation than in the structure including a thumb screw 62 having a screw portion 66 over the entire area.

In the image forming apparatus 10 illustrated in FIG. 3, the rotational force caused in the driver 26 is transmitted to the fixing roller 44 via the coupling members 34 and 48. In the removable structure 30, the coupling members 34 and 48 are prevented from being degraded. This structure thus further reduces variation of the rotational force transmitted to the fixing roller 44 than the structure not including the removable structure 30. The image forming apparatus 10 illustrated in FIG. 1 thus prevents the fixed toner from being displaced from a predetermined fixed position on the sheet P and reduces defects of the toner image G.

Second Exemplary Embodiment

An assembly removable structure and an image forming apparatus according to a second exemplary embodiment are described now as examples. Components or portions basically the same as those of the first exemplary embodiment are denoted with the reference signs the same as those of the first exemplary embodiment and not described.

Figure 7:
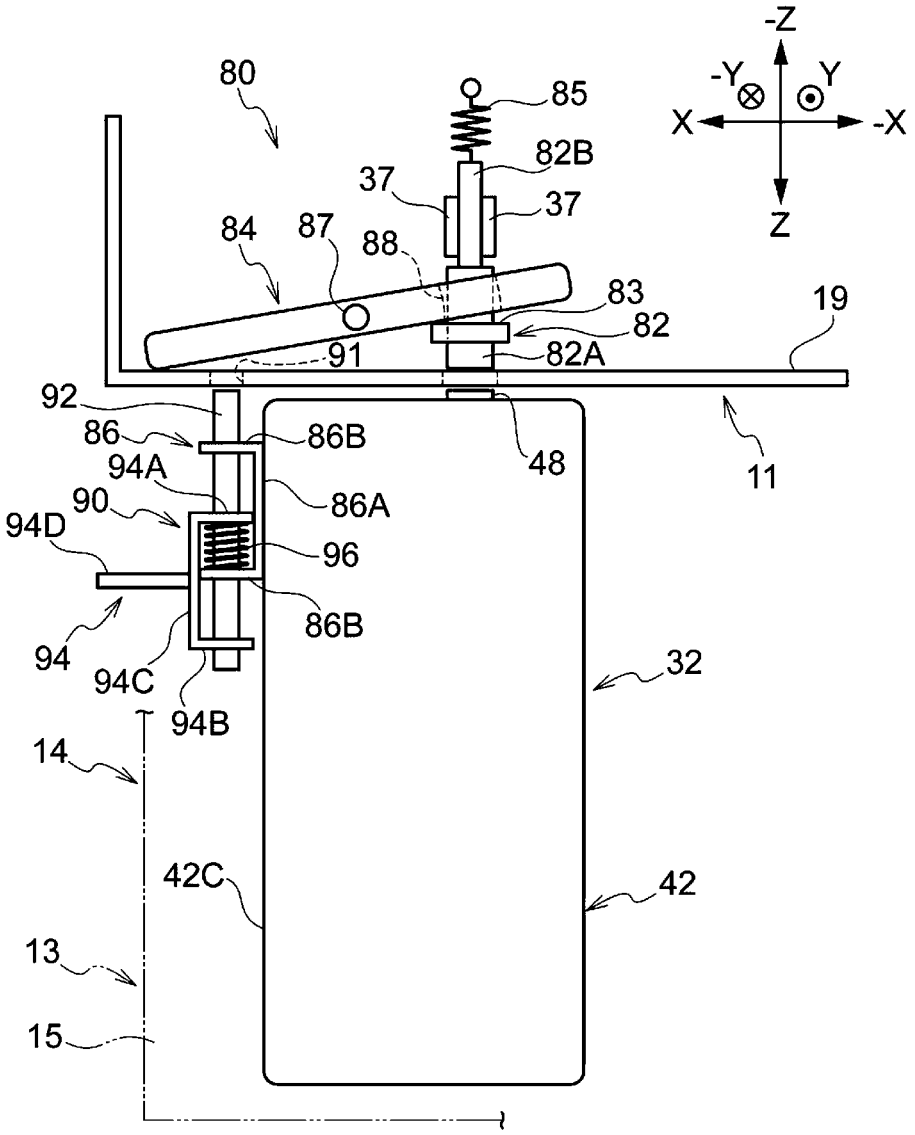
FIG. 7 illustrates a removable structure according to a second exemplary embodiment.

FIG. 7 illustrates a removable structure 80, which is an example of the assembly removable structure according to the second exemplary embodiment. The removable structure 80 is provided instead of the removable structure 30 (see FIG. 2) of the image forming apparatus 10 (see FIG. 2) according to the first exemplary embodiment.

The removable structure 80 includes a fixing unit 32, a coupling member 82 on the apparatus body 11, a link member 84, and a restricting portion 90. The coupling member 82 is an example of a connection member. The link member 84 is an example of a switch member. The restricting portion 90 is an example of a restricting device. The side plate 19 is disposed as an example of a partitioning member.

The fixing unit 32 includes a bracket 86, instead of the bracket 43 (see FIG. 2) according to the first exemplary embodiment. The fixing unit 32 has the same structure according to the first exemplary embodiment except the bracket 86. A side plate disposed on the X side of the center of the housing 42 and extending in the Y–Z plane is referred to as a front plate 42C. The fixing unit 32 is attached to the receiving member 13 (on the bottom plate 15).

The bracket 86 is attached to the –Y side end portion and the –Z side end portion of the front plate 42C with a screw, not illustrated. When viewed in the Y direction, the bracket 86 has a U-shaped cross section opening to the X side. The bracket 86 includes an attachment portion 86A, attached to the front plate 42C, and two supports 86B, extending to the X side from both end portions of the attachment portion 86A in the Z direction. The two supports 86B each have a through hole, not illustrated and extending through the support 86B in the Z direction.

Coupling Member

The coupling member 82 includes, for example, a connection portion 82A, having a cylindrical shape having an axis extending in the Z direction, and a shaft portion 82B, extending from the connection portion 82A to the –Z side in the Z direction. The connection portion 82A has a contact surface 83 having an annular shape when viewed from the –Z side in the Z direction. The coupling member 82 is rotatable in the apparatus body 11 about the axis extending in the Z direction.

The shaft portion 82B is supported by the guide members 37 disposed on the apparatus body 11 to be movable in the Z direction. The coupling member 82 is movable toward the side plate 19 to the Z side and away from the side plate 19 to the –Z side. The coupling member 82 is pulled to the –Z side by an extension spring 85 pulling the shaft portion 82B.

The connection portion 82A has multiple recesses, not illustrated, at intervals in the circumferential direction. These recesses are disposed to engage with protrusions, not illustrated, of the coupling member 48. Specifically, the coupling member 82 in a projecting state is connected to the coupling member 48. The coupling member 82 transmits the rotational force to the coupling member 48 by being driven to rotate by the driver 26 (see FIG. 3). For ease of understanding the structure of the coupling member 82, FIG. 7 illustrates the structure in which the shaft portion 82B is pulled by the extension spring 85. Actually, the shaft portion 82B is driven to rotate by a gear of the driver 26, not illustrated, and the connection portion 82A is pulled to the –Z side by the extension spring 85.

Link Member

The link member 84 is disposed, for example, on the opposite side of the side plate 19 from the receiving member 13 (disposed on the –Z side opposite to the Z side). The link member 84 is formed of a plate member having a thickness in the Z direction and a height in the Y direction. The link member 84 has a cylindrical support shaft 87 at the center in the X direction. The support shaft 87 extends to the Y side and the –Y side. The support shaft 87 is supported by a bracket of the apparatus body 11, not illustrated, to be rotatable about the axis extending in the Y direction.

The link member 84 has a guide hole 88, extending through the link member 84 in the Z direction. When the link member 84 is viewed in the Y direction, the guide hole 88 is disposed at a portion of the link member 84 on the –X side of the support shaft 87. When viewed in the Y direction, the hole wall of the guide hole 88 has a surface curved in an arc having the support shaft 87 at the center. The guide hole 88 has a size capable of receiving the connection portion 82A and allowing the edge of the guide hole 88 and the contact surface 83 to come into contact with each other.

In the state where the link member 84 is not in contact with any object on the X side of the support shaft 87, the coupling member 82 is apart from the coupling member 48 to the –Z side. The position of the link member 84 in this state is referred to as a second position.

Figure 8:
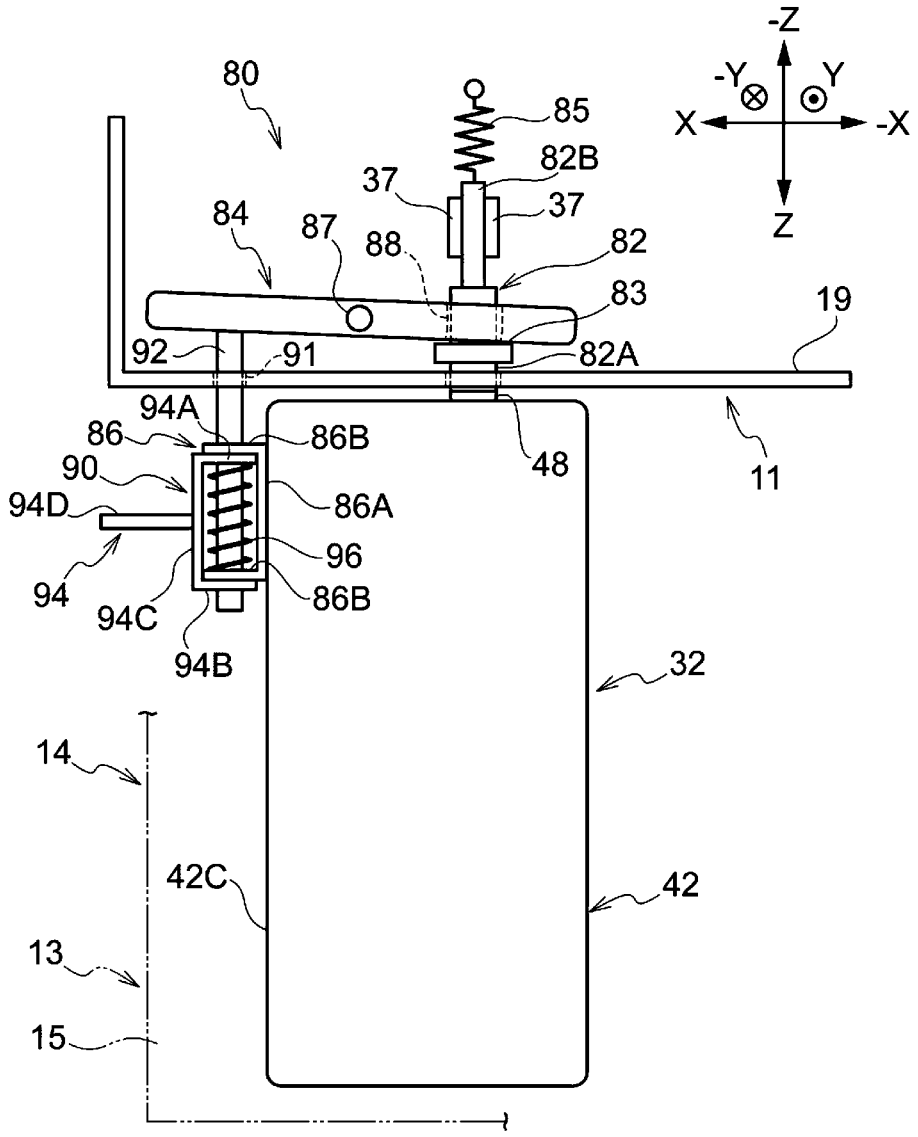
FIG. 8 illustrates a coupling member in the removable structure according to the second exemplary embodiment in a connected state.

As illustrated in FIG. 8, on the other hand, when the link member 84 is in contact with a restricting pin 92, described below, the coupling member 82 is connected to the coupling member 48. The position of the link member 84 in this state is referred to as a first position. Here, the coupling member 82 is capable of moving forward to the Z side and backward to the –Z side as a result of the link member 84 being rotated about the support shaft 87 and switched between the first position and the second position.

As described above, the link member 84 is disposed on the side across from the receiving member 13. In other words, in the second exemplary embodiment, the side plate 19 is an example of a partitioning member that separates the opening 14 of the receiving member 13 from the space in which the link member 84 is disposed. The side plate 19 has a through hole 91 of a size capable of receiving a restricting pin 92, described below. The through hole 91 extends through the side plate 19 in the Z direction. Part of the link member 84 on the –Z side of the support shaft 87 is aligned with the through hole 91 in the Z direction. The link member 84 is operated independently of the covering 12 (see FIG. 1). Operated independently here refers to the case where the link member 84 is not moved by when the covering 12 is operated, and the covering 12 is not moved when the link member 84 is operated.

Restricting Portion

The restricting portion 90 illustrated in FIG. 7 includes a restricting pin 92, which is an example of a restricting device (restricting member), a lever member 94, and a coil spring 96, which is an example of a pressing member.

The restricting pin 92 has a cylindrical shape having an axis extending in the Z direction. The restricting pin 92 is inserted into through holes, not illustrated, in the two supports 86B of the bracket 86. Specifically, the restricting pin 92 is supported by the two supports 86B to be movable in the Z direction. The restricting pin 92 is disposed to face the through hole 91 in the Z direction while the fixing unit 32 is attached to the receiving member 13.

The lever member 94 includes, for example, a plate portion 94A, a plate portion 94B, a link portion 94C, and an operation portion 94D. The plate portions 94A and 94B are disposed to extend in the X-Y plane and to face each other at a distance apart from each other in the Z direction. The plate portion 94A is disposed on the −Z side and the plate portion 94B is disposed on the Z side. The plate portions 94A and 94B each have a through hole, not illustrated, into which the restricting pin 92 having its axis extending in the Z direction is inserted. The link portion 94C connects the X side end portions of the plate portions 94A and 94B in the Z direction. The operation portion 94D extends to the X side from the center of the link portion 94C in the Z direction.

The coil spring 96 is held between the plate portion 94A and the support 86B on the Z side to contract or expand in the Z direction. While the coil spring 96 is held between the plate portion 94A and the support 86B on the Z side, the restricting pin 92 is inserted into through holes, not illustrated, of the plate portion 94B, the support 86B on the Z side, the plate portion 94A, and the support 86B on the −Z side. Here, the restricting pin 92 is also inserted into the coil spring 96. The restricting pin 92 is prevented from being removed from the bracket 86 and the lever member 94 while having an E-ring, not illustrated, attached to its outer peripheral portion while the −Z side end portion is protruding to the −Z side beyond the support 86B.

Here, as illustrated in FIG. 8, in the state where the fixing unit 32 is attached to the receiving member 13, the restricting pin 92 extends through the through hole 91 of the side plate 19 and is aligned with part of the link member 84 in the Z direction. In this state, the coil spring 96 presses the restricting pin 92 against the link member 84 to switch the link member 84 to the first position. When moved in the Z direction (−Z side) and inserted into the through hole 91, the restricting pin 92 comes into contact with the hole wall of the through hole 91 in the X direction. Specifically, the restricting pin 92 coming into contact with the hole wall of the through hole 91 in the X direction restricts the fixing unit 32 from being removed from the receiving member 13.

Operation

The operation of the second exemplary embodiment is described now.

When the fixing unit 32 illustrated in FIG. 7 is attached to the receiving member 13, the restricting pin 92 is displaced to the Z side as a result of the side plate 19 and the restricting pin 92 coming into contact with each other and the coil spring 96 is in a contracted state.

Subsequently, as illustrated in FIG. 8, the restricting pin 92 is inserted into the through hole 91 of the side plate 19 and comes into contact with the link member 84. The restricting pin 92 switches (rotates) the link member 84 from the second position to the first position. While the link member 84 is being switched to the first position, the link member 84 comes into contact with the contact surface 83 of the coupling member 82, so that the coupling member 82 moves forward to the Z side and is connected to the coupling member 48.

When the restricting pin 92 comes into contact with the hole wall of the through hole 91, the fixing unit 32 is restricted from moving to the X side. Specifically, the fixing unit 32 is restricted from being removed from the receiving member 13. To remove the fixing unit 32 from the receiving member 13, the operation portion 94D is operated to the Z side to pull the restricting pin 92 out of the through hole 91, so that the fixing unit 32 is allowed to be removed.

As described above, in the removable structure 80, the restricting pin 92 switches the link member 84 from the second position to the first position with an operation of restricting removal of the fixing unit 32 from the receiving member 13. This structure eliminates the need of separately performing the operation of restricting the fixing unit 32 from being removed and the operation of switching the link member 84 from the second position to the first position. This structure simplifies the operation compared to the structure that separately performs the operation of restricting the fixing unit 32 from being removed and the operation on the link member 84.

The operation of switching the link member 84 from the first position to the second position is performed independently of opening and closing of the covering 12 (see FIG. 1). Neither the link member 84 is switched nor the coupling member 82 is moved, even though the covering 12 is opened or closed after, for example, the transport path A (see FIG. 1) is jammed with a sheet P in the middle. This structure reduces degradation of the coupling member 82 further than the structure in which opening or closing of the covering 12 is linked with switching of the link member 84. The degradation of the coupling member 82 here includes excessive wearing of a connection portion between the coupling members 82 and 48 being displaced with each other in the X direction and flaws caused by the outer peripheral surfaces of the coupling members 82 and 48 coming into contact with each other.

In the removable structure 80, the direction (X direction) in which the fixing unit 32 is attached to or removed from the receiving member 13 crosses (is perpendicular to) the direction (Z direction) in which the restricting pin 92 is operated to switch the link member 84. This structure more strictly restricts the movement of the restricting pin 92 in the X direction than the structure that allows the restricting pin 92 to move in the X direction to restrict the fixing unit 32 from being removed. Specifically, the position of the restricting pin 92 is prevented from being displaced in the X direction from a predetermined position. This structure enhances the accuracy of the position of the fixing unit 32 in the X direction, attached to the receiving member 13.

In the removable structure 80, the coil spring 96 presses the restricting pin 92 against the link member 84. The direction in which the coil spring 96 exerts a pressing force on the restricting pin 92 is the direction in which the link member 84 moves to the first position. Specifically, the link member 84 receives the pressing force directed in the direction in which the coupling members 82 and 48 are connected together. This structure more effectively prevents the coupling members 82 and 48 from being disconnected from each other than the structure that does not include the coil spring 96.

In the removable structure 80, the side plate 19 separates the opening 14 of the receiving member 13 from the space in which the link member 84 is disposed. This structure prevents the link member 84 from being directly operated through the opening 14 and thus more effectively prevents the link member 84 from being mishandled than the structure that does not include the side plate 19.

In the image forming apparatus 10 according to the second embodiment, the rotational force caused in the driver 26 (see FIG. 3) is transmitted to the fixing roller 44 (see FIG. 3) via the coupling members 82 and 48. In the removable structure 80, the coupling members 82 and 48 are prevented from being degraded. This structure thus further reduces variation of the rotational force transmitted to the fixing roller 44 than the structure not including the removable structure 80. This structure thus prevents the fixed toner from being displaced from a predetermined fixed position on the sheet P and reduces defects of the toner image G.

The present invention is not limited to the above-described exemplary embodiments.

MODIFICATION EXAMPLE

Figure 9:
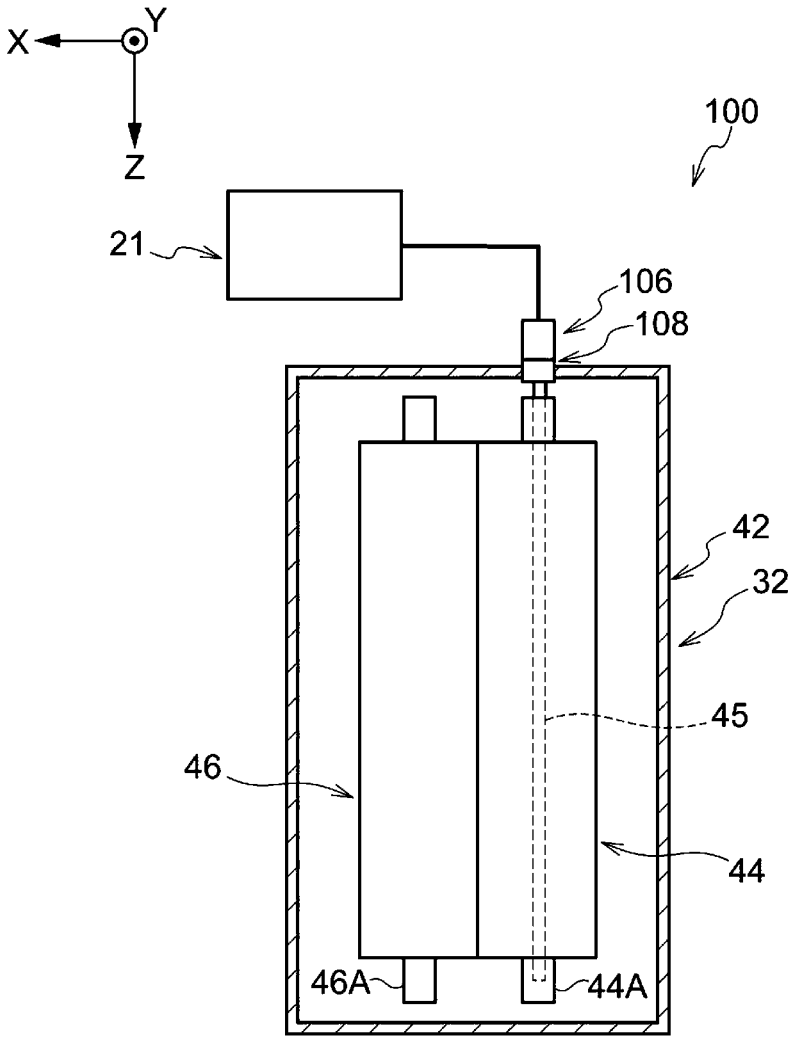
FIG. 9 illustrates a fixing unit and a power unit according to a modification example of the first exemplary embodiment.

FIG. 9 illustrates part of an image forming apparatus 100 according to a modification example. The image forming apparatus 100 includes a connector 106, which is an example of a connection member, and a connector 108, which is an example of a connectable member, instead of the coupling members 34 and 48 (see FIG. 3) in the removable structure 30 (see FIG. 1) of the image forming apparatus 10. Components and portions other than the connectors 106 and 108 are the same as those of the image forming apparatus 10 and the removable structure 30. The driver 26 (see FIG. 3) rotates the fixing roller 44 using gears, not illustrated.

The connectors 106 and 108 each include multiple terminals, not illustrated, and are capable of being energized while being connected together. The connector 106 is movable forward and backward in the Z direction. A power supply 21 energizes the connectors 106 and 108. A halogen heater 45 is an example of a heat generator. The halogen heater 45 generates heat when energized by the power supply 21 through the connectors 106 and 108 to fix a toner image G (see FIG. 1) to a sheet P.

The image forming apparatus 100 prevents connection portions (terminals) of the connectors 106 and 108 from being degraded with the effects the same as those of the removable structure 30 according to the first exemplary embodiment. This structure further reduces variation of power fed to the halogen heater 45 than the structure not including the removable structure 30. This structure thus prevents the amount of heat fed to the toner fixed to the sheet P from falling below the predetermined amount of heat, and thus reduces defects (such as a cold-offset) of the toner image G.

OTHER MODIFICATION EXAMPLES

In the removable structure 30, for example, a plate member extending in the Y-Z plane may be moved in the Y direction to restrict the fixing unit 32 from being removed and to move the link member 36 to the first position. In the removable structure 30, the shaft portion 64 of the thumb screw 62 may have the screw portion 66 throughout the shaft portion 64. The removable structure 30 may omit the side plate 19. In the removable structure 30, a plate member may be disposed between the bracket 43 and the link member 36 as an example of a partitioning member.

In the removable structure 80, for example, a plate member extending in the Y-Z plane may be moved in the Y direction to restrict the fixing unit 32 from being removed and may be brought into contact with the link member 84 to move the link member 84 to the first position. The removable structure 80 may omit the coil spring 96. The removable structure 80 may include the connectors 106 and 108.

The assembly is not limited to the fixing unit 32 and may be, for example, the image forming unit 25, the transfer unit 27, or a unit for correcting bends of the sheets P.

The fixing unit 32 may be attached and removed in the Z direction or the Y direction instead of the X direction. The direction in which a restricting device is operated may be determined to be a direction the same as or crossing the direction in which the fixing unit 32 is attached or removed.

Instead of the bottom plate 15, the front plate 17, and the side plate 19 that cover the entirety of contact portions between the link member 36 and the thumb screw 62, the partitioning member may cover part of the contact portions.

A rotator may be, instead of the fixing roller 44, a fixing belt or a transfer roller of a transfer unit.

The thumb screw 62 may be held or not held by the fixing unit 32 (bracket 43) in the state where the fixing unit 32 is removed from the receiving member 13. The thumb screw 62 is not limited to have a structure that restricts removal of the fixing unit 32 within the range of the screw portion 66 after the link member 36 is switched within the range of the non-screw portion 68. Specifically, the thumb screw 62 may perform part of switching of the link member 36 and restriction on the fixing unit 32 within the range of the screw portion 66.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An assembly removable structure, comprising:

an assembly that includes a connectable member and that is attached to and removed from a receiving member of an apparatus body in a first direction;

a connection member disposed on the apparatus body to be movable forward and backward in a cross direction that crosses the first direction, the connection member being connected to the connectable member while being in a projecting state;

a switch member that is operated independently of a lid member and that is capable of switching the connection member between a first position, in which the connection member is connected to the connectable member, and a second position, in which the connection member is removed from the connectable member, the lid member rendering the receiving member open and closed; and a restricting device that restricts removal of the assembly while the assembly is being attached to the receiving member, the restricting device switching the switch member from the second position to the first position with an operation of the restriction.

2. The assembly removable structure according to claim 1, wherein the restricting device restricts removal of the assembly by being moved in the first direction.

3. The assembly removable structure according to claim 2, wherein the restricting device has a stick shape having an axis extending in the first direction, the restricting device including a screw portion and a non-screw portion on an outer circumferential surface, the screw portion including an external screw and being disposed on a base end side, and the non-screw portion not including the external screw, and wherein the apparatus body includes a body member including an internal thread that engages with the external screw when the switch member is in the first position.

4. The assembly removable structure according to claim 1, wherein the restricting device restricts removal of the assembly by being moved in the cross direction.

5. The assembly removable structure according to claim 4, further comprising a pressing member that presses the restricting device to the switch member to switch the switch member to the first position.

6. The assembly removable structure according to claim 1, further comprising a partitioning member that separates an opening of the receiving member from a space in which the switch member is disposed.

7. An image forming apparatus that forms an image on a recording medium, the image forming apparatus comprising the assembly removable structure according to claim 1, wherein each of the connection member and the connectable member is rotatable about an axis extending in the cross direction, wherein the apparatus body includes a driver that drives the connection member to rotate, and wherein the assembly includes a rotator that rotates with a rotational force transmitted from the driver via the connection member and the connectable member.

8. An image forming apparatus that forms an image on a recording medium, the image forming apparatus comprising the assembly removable structure according to claim 1, wherein the connection member and the connectable member are capable of being energized while being connected together, wherein the apparatus body includes a power supply that energizes the connection member and the connectable member, and wherein the assembly includes a heat generator that generates heat when energized by the power supply via the connection member and the connectable member, and that fixes an image to the recording medium.

* * * * *